US011541419B2

(12) United States Patent
Fessehaye et al.

(10) Patent No.: US 11,541,419 B2
(45) Date of Patent: Jan. 3, 2023

(54) APPARATUS AND METHOD FOR THE DRYING/CURING OF CHEMICAL PRODUCTS

(71) Applicant: CEFLA Società Cooperativa, Imola (IT)

(72) Inventors: Asefaw Fessehaye, Imola (IT); Cristian Giovannini, Imola (IT)

( * ) Notice: Subject to any disclaimer, the term of this patent is extended or adjusted under 35 U.S.C. 154(b) by 20 days.

(21) Appl. No.: 17/311,323

(22) PCT Filed: Feb. 24, 2020

(86) PCT No.: PCT/IB2020/051525

§ 371 (c)(1),
(2) Date: Jun. 7, 2021

(87) PCT Pub. No.: WO2020/174352

PCT Pub. Date: Sep. 3, 2020

(65) Prior Publication Data

US 2022/0118478 A1 Apr. 21, 2022

(30) Foreign Application Priority Data

Feb. 25, 2019 (IT) ..... 102019000002653

(51) Int. Cl.
*B05D 3/06* (2006.01)
*B05D 3/04* (2006.01)
(Continued)

(52) U.S. Cl.
CPC ..... *B05D 3/067* (2013.01); *B05D 3/0466* (2013.01); *B05D 3/0486* (2013.01); *B05D 3/066* (2013.01);
(Continued)

(58) Field of Classification Search
None
See application file for complete search history.

(56) References Cited

U.S. PATENT DOCUMENTS 5,046,264 A * 9/1991 Hultzsch ..... F26B 15/12 34/245
5,529,081 A * 6/1996 Kappler ..... C25D 17/00 134/131
(Continued)

FOREIGN PATENT DOCUMENTS

DE 102008061244 6/2010
DE 102008061244 A1 * 6/2010 ..... B05D 3/067
EP 2418019 2/2012

*Primary Examiner* — Binu Thomas
(74) *Attorney, Agent, or Firm* — Themis Law

(57) ABSTRACT

An apparatus for matting a coating applied on mainly flat panels includes a cleaning workstation and an excimer treatment workstation where the panels are conveyed by a belt conveyor having an upper outward section and a lower return section. In the cleaning workstation, the upper outward section of the belt conveyor has a V-shaped path, which is formed by two rollers in contact with the plane of advancement of the panel, and a roller in lower position, and which is bridged by advancing rollers, among which gaseous nitrogen is supplied that brushes all sides of the panel. In the treatment workstation, the upper outward section of the belt has a V-shaped path, where the panel is irradiated by an excimer emitter, and which is formed by two rollers in contact with the plane of advancement of the panel, and a roller in lower position, and is bridged by advancing rollers.

7 Claims, 5 Drawing Sheets

(51) Int. Cl.
*B05D 5/02* (2006.01)
*B08B 5/02* (2006.01)
*B08B 13/00* (2006.01)

(52) U.S. Cl.
CPC ..... *B05D 5/02* (2013.01); *B08B 5/023* (2013.01); *B08B 13/00* (2013.01); *B05D 2252/04* (2013.01)

(56) References Cited

U.S. PATENT DOCUMENTS

| | | | | |
|---|---|---|---|---|
| 6,021,790 | A * | 2/2000 | Yoshitani | B65G 49/064 134/122 R |
| 2004/0045575 | A1* | 3/2004 | Kinoshita | C03C 23/0075 134/1 |
| 2013/0011573 | A1* | 1/2013 | Nakashima | C09J 4/00 118/620 |
| 2013/0129980 | A1 | 5/2013 | Meinhard | |

* cited by examiner

APPARATUS AND METHOD FOR THE DRYING/CURING OF CHEMICAL PRODUCTS

FIELD OF THE INVENTION

The present invention relates to an apparatus and a method for the photopolymerization/drying of photopolymerizable/dryable chemical products (paints) through UV radiations. In particular, the invention relates to an oven for the photopolymerization/drying of painted panels made of sundry materials (wood, fibrocement, glass, plastics, etc.) capable of conferring a matt (opaque) finishing to mainly flat panels having a non-planar surface (raised or shaped panels), on five of their six sides.

BACKGROUND OF THE INVENTION

Raised panels are panels wherein at least one of the main sides is not planar, but there are provided some reliefs, e.g. in the shape of a rhombus, lozenge or ellipse. Such raised panels are well-known in the art and are used to produce furniture doors (mainly kitchens) and doors.

The surface finish of furniture belongs to two main families:

Glossy finish, wherein the surface reflects light; in the most extreme cases the glossy finish is reflecting and a mirroring effect occurs;

Matt finish, wherein the surface does not reflect light; usually such finish is due to the presence of a plurality of microdepressions on the surface of the painted panel, which capture light preventing its reflection like in a mirror.

The degree of opacity of finish is usually evaluated with a numeric index ranging 1-100, wherein the panels with glossy finish score around 100, while the panels with matt finish score around 2-5. In the art, a matt finish can have a score up to 30-40, while the finishes having an index of 50-80 are indicated as semi-glossy.

In the art, industrial methods for obtaining such matt finish are known. One of the documents disclosing such a method is e.g. EP2198981B1 of IOT Innovative Oberflachentechnologien GmbH. Such document discloses a method wherein the panel coated with monomers and/or oligomers of acrylate and methacrylate undergoes a treatment with a xenon and/or argon excimer emitter and a mercury medium pressure emitter, under an inert gas.

Nonetheless, the method of said patent does not allow obtaining a matt finish of raised panels also on their lateral edges, but only on one or both main panel surfaces (in successive steps).

It is known that the excimer treatment for being successful must occur in an inert atmosphere, i.e. an oxygen-free atmosphere. The content of oxygen in the natural earth atmosphere is around 21%. Typically, when working in an oxygen-free atmosphere is necessary, oxygen is replaced with nitrogen, which is a harmless gas, widely used in industry.

In the art, panels to be painted and subsequently dried/finished are conveyed through closed belt conveyors. Typically, two rollers actuate the closed belt; usually one of them is motorized while the other is an idle roller. In lateral view, the closed belt assumes an oval shape, with its two long sides parallel to each other. Panels are carried by the upper outward section (advancement plane, substantially coinciding with the upper outward section), while the lower section is the return section. Moreover, belt conveyors provided with tensioning pulleys are known, having a shape similar to the oval shape, but provided with at least a portion of belt forming a V-shaped attachment which leaves the plane. Documents showing such particular paths of the belt are e.g. CN107804675 of Changan University, KR20000020762, KR20030042991 of Posco. Nonetheless, it is worth noting that such tensioning pulleys, having the aim of tensioning the conveying belt, in the quoted documents are provided on the return section only.

In the art, roller conveyors for advancing panels in production lines are known. Generally, such rollers are provided with a planar surface. Nonetheless, even rollers having non-planar surfaces are known, like e.g. CN105858113 of Machine Repair Plant Yunnan Xiaolongtan Mining Bureau, CN105501879 of Jiangyin Dongchen Machinery Manufacturing, CN106628931 of Hengyang Conveying Machinery.

SUMMARY OF THE INVENTION

A first aim of the present invention is providing an excimer oven capable of conferring a matt finish to a panel provided with at least one non-planar main surface.

A further aim and second aim of the present invention is further improving an apparatus and a method for coating with a matt finish a panel allowing a coating the main surface and all the lateral edges of a panel in just one industrial step.

The above first object is achieved by an apparatus and a method having the features of the independent claims.

Due to the configuration of the conveyor belt forming a V-shaped path and at which the belt is no longer in contact with the panel which is supported by rollers at certain points, a chamber is formed allowing a better distribution of the inert gas, i.e. nitrogen atmosphere which enhances the efficiency of the matting action.

Independent claim 2 introduces a further roller additional to the ones of the rollers supporting the panel which generates a further effect of generating turbulences in the inert gas atmosphere.

Advantageous embodiments and refinements are specified in claims dependent thereon.

One of the said refinements consist of proving a biconical roller as claimed in claim 3, said roller further enhancing the effect of matting the coating also on the edges of a panel.

The panel treatment method according to the present invention comprises the following steps:

A first step wherein the panels are first coated and then gelled through UV radiations gelling the coating film; said step occurs upstream the apparatus according to the present invention, in natural atmosphere, i.e. an atmosphere containing about 21% of oxygen;

A second step wherein the panels undergo the action of radiations emitted by an excimer lamp working in an inert atmosphere, having the aim of matting the coating, the lamp being provided inside the apparatus according to the present invention;

A third step for the complete drying of the matted coating film, occurring downstream the apparatus according to the presence invention, in a natural atmosphere, i.e. an atmosphere containing about 21% of oxygen.

The apparatus according to the present invention comprises three workstations:

An initial workstation supplying gaseous nitrogen, placed at the entrance of the apparatus according the present invention;

A cleaning workstation, allowing to remove from the surface of the panel oxygen molecules which would hinder the matting action promoted by the excimer emitters;

A treatment workstation provided with an excimer emitter.

Both the cleaning and treatment workstations are placed in correspondence to a belt conveyor forming a V-shaped path in order to favor the cleaning and treatment of the panels to be matted.

In particular, in the treatment workstation, one of the rollers supporting the panels passing over the V-shaped path is worked so as to favor the diffusion of light on all the lateral edges of the panel to be matted.

A first advantage of the present invention consists in the possibility of coating five out of six sides (the main side and the four lateral sides) with a matt finish in just one industrial step. As of today, in fact, excimer ovens are provided for the coating of the main side only, while the lateral edges of a panel must be treated differently, e.g. with covering systems, or with dedicated, subsequent working steps.

A second advantage of the present invention is that the matt finish according to the present invention is very scratch-resistant.

A third advantage is the soft touch of these matt surfaces.

A fourth advantage is the anti-fingerprint effect of the surface, meaning that when a hand touches the matt surface, on the surface no visible fingerprints are left.

A fifth advantage is the minimization of the portion of the plant that must be supplied with an inert atmosphere, in that the gaseous nitrogen is relatively expensive.

BRIEF DESCRIPTION OF THE DRAWINGS

Further advantages and properties of the present invention are disclosed in the following description, in which exemplary embodiments of the present invention are explained in detail on the basis of the drawings.

DETAILED DESCRIPTION OF EMBODIMENTS OF THE INVENTION

Figure 1:
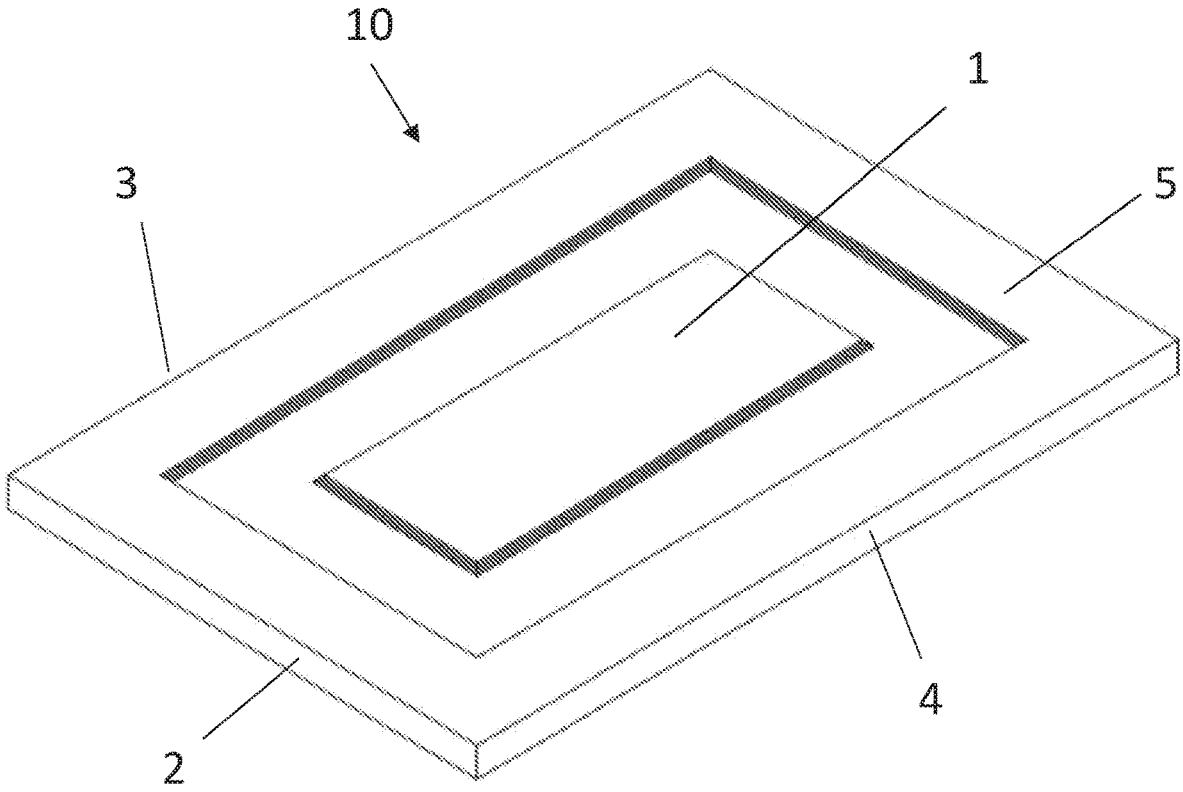
FIG. 1: Example of a raised panel, axonometric view.

FIG. 1 shows an axonometric view of an example of a raised furniture door. A panel 10 is provided with two main sides, the upper side 1 and its opposed side, which is not visible in the Figure; a head edge 2, a tail edge 5 and two longitudinal edges 3 and 4. The raising is clearly visible in the Figure on the main side 1. In the present description, overall the head edge 2, the tail edge 5 and the two longitudinal right 3 and left edge 4 are grouped in the term lateral edges. Coating five out of six sides of the panel 10 means coating the main side 1 and the lateral edges 2, 3, 4, 5.

Figure 2:
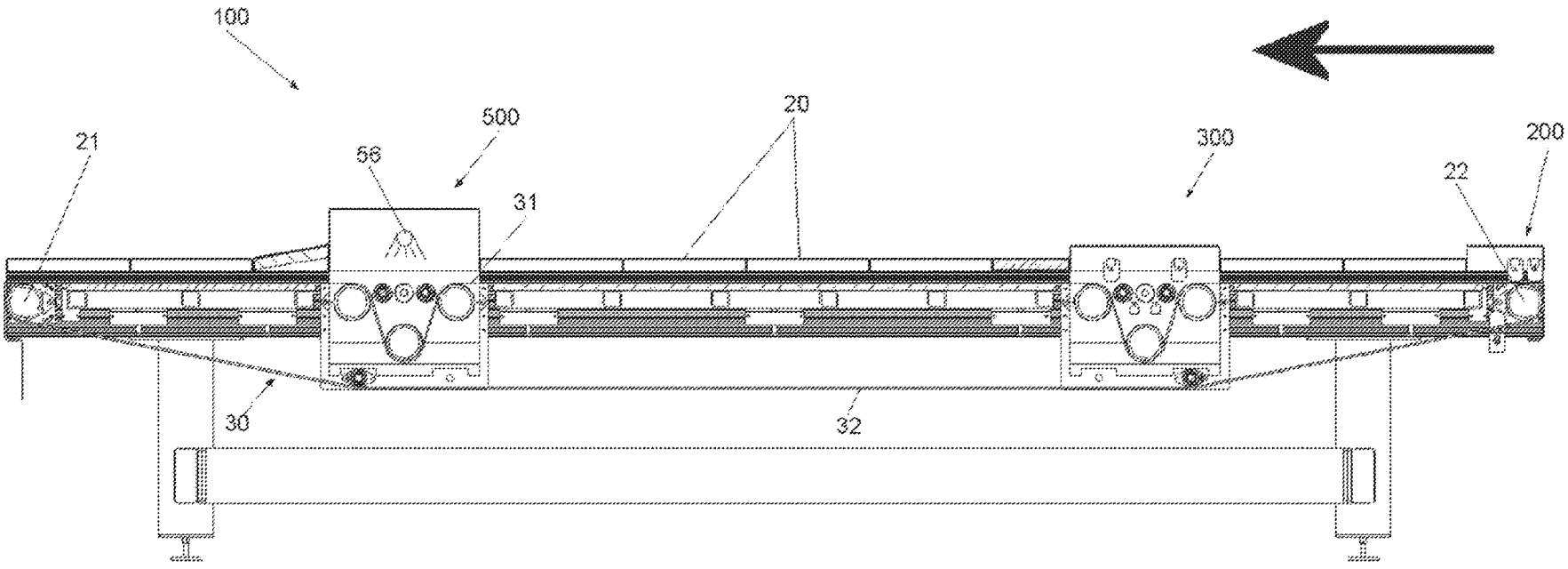
FIG. 2: Longitudinal section of the apparatus according to the present invention.

FIG. 2 shows a longitudinal section of an apparatus 100 for matting panels through excimer treatment according to the present invention. The advancing of the panel 10 inside the apparatus 100 occurs in the direction indicated by the bold arrow, in an inert atmosphere supplied with gaseous nitrogen. Said apparatus 100 comprises a plurality of housings 20 intended for insulating the panels from natural atmosphere, keeping them inside an inert chamber 120, better visible in FIG. 5. The assembly of the housings 20 forms a tunnel-like chamber 120 extending in the advancement direction of the upper outward section of a belt conveyor.

Moreover, the apparatus 100 comprises an initial workstation 200 for supplying gaseous nitrogen, a cleaning workstation 300 and a treatment workstation 500.

Said apparatus 100 further comprises a belt conveyor 30 covered with a section covering formed by said housings 20 intended for providing an inert chamber.

The closed belt 30 causes the advancement of panels 10 to be treated. The closed belt 30 is provided with the known shape, providing an upstream outward section 31 and a lower return section 32, actuated by end rollers 21 and 22, of which the roller 21 is a motorized roller, while the roller 22 is an idle roller.

Upstream the apparatus 100 the panels 10 are coated on five sides (main side 1 and all lateral edges 2, 3, 4, 5), preferably spray-coated. The coating contains polymerizable monomers in a suitable solvent, and a photoinitiator sensible to UV radiation. Again upstream said apparatus 100, successively the coating applied on the panel 10 preferably undergoes a gelling treatment, preferably through an UV LED lamp.

Figure 3:
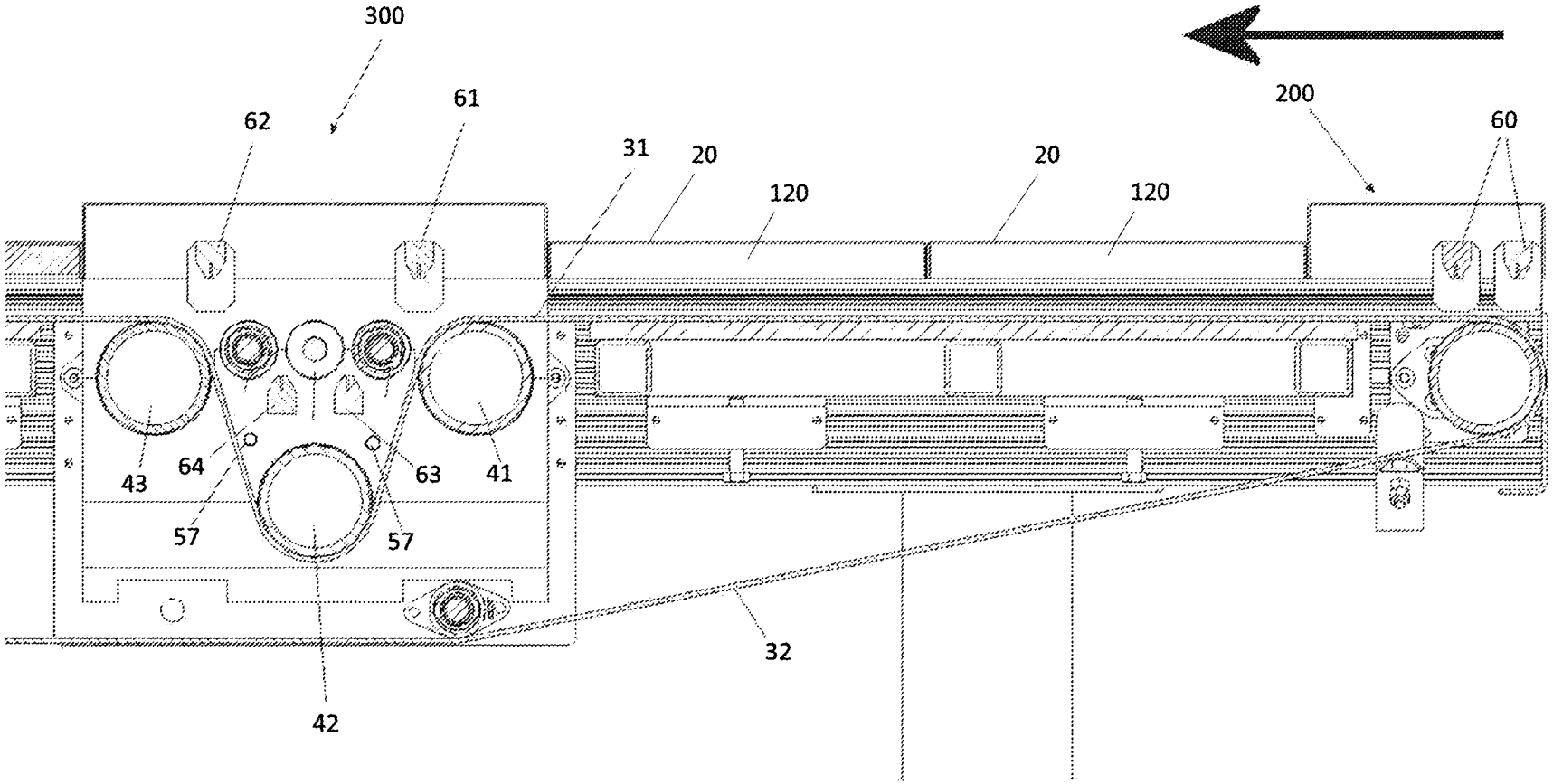
FIG. 3: Longitudinal section of a detail of the cleaning workstation.

FIG. 3 shows a detail of the initial workstation 200 for providing gaseous nitrogen, placed at the entrance of panels 10 into apparatus 100. Said initial workstation 200 comprises at least a device 60, preferably two devices 60 for supplying gaseous nitrogen in the initial portion of the panels path.

Moreover, FIG. 3 shows a detail of the cleaning workstation 300 in a lateral section. Inside the cleaning workstation, the upper outward section 31 for conveying panels 10 takes a V shape thanks to three rollers: a first roller 41, a second roller 42, and a third roller 43. The two first and third rollers 41 and 43 lie on the same plane, and are placed immediately under the upper outward section 31 of the belt conveyor 30, and therefore immediately under the advancement plane of panels 10. The second roller 42 lies on a plane lower than the plane of rollers 41 and 43, so forming a V-shaped path of the upper outward section 31 of the belt conveyor 30.

The panels 10 advance in the direction indicated by the bold arrow, lying with their (non-coated) bottom side on three motorized advancing rollers 51, 52, 53. After said rollers, the panels are again supported by the upper outward section 31 of the belt conveyor. Said rollers 51, 52, 53 are smooth metal rollers.

Above the advancing plane of panels 10 there are provided two devices 61, 62 for supplying gaseous nitrogen, while under the advancing plane there is provided a third device 63, and optionally a fourth device 64 for supplying gaseous nitrogen.

Said devices 61, 62, 63, 64 for supplying gaseous nitrogen are as long as the width of the belt conveyor 30, and anyway are provided with a length longer than the panel to be treated; they supply gaseous nitrogen in a laminar way, which brushes all the surfaces of the panel 10.

Overall, the devices 61, 62, 63, 64 supplying gaseous nitrogen constitute the cleaning workstation 300 of the panel 10, intended for removing as much as possible from the surfaces 1, 2, 3, 4, 5 of the panel to be treated the oxygen molecules deriving from the natural atmosphere outside the apparatus 100.

Inside the cleaning workstation 300 there are preferably provided pipes 57 for suctioning the oxygen removed from the surface of the panel 10 thanks to the nitrogen supply, and a (not shown) suctioning device, intended for removing oxygen from the chamber 120.

Once the panel 10 is beyond the cleaning workstation 300 and is supported again by the upper outward section 31 of the conveyor belt 30, the panel continues its conveying towards the excimer treatment workstation 500. Such conveying occurs obviously inside the chamber 120 containing an inert atmosphere (nitrogen).

Figure 4:
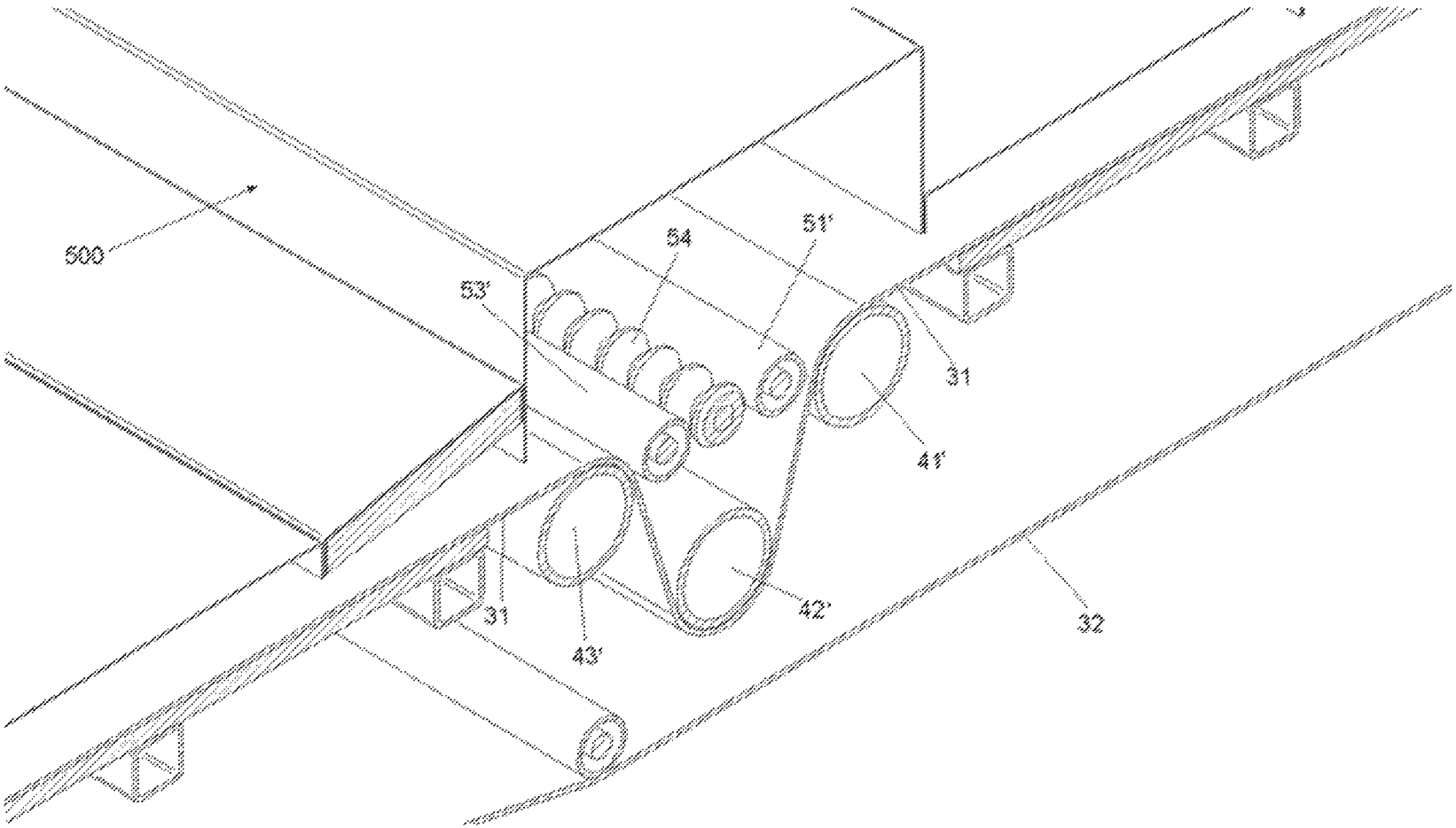
FIG. 4: Axonometric view of a detail of the treatment workstation.

FIG. 4 shows the treatment workstation 500 in an axonometric view. Said treatment workstation 500 is provided with a structure analogue to that of the cleaning workstation 300, with a similar V-shaped path formed by the upper outward section 31 thanks to the presence of three rollers: a first roller 41', a second lower roller 42', and a third roller 43', analogue to the above-described rollers 41, 42, 43.

The panels 10 advance in the direction indicated by the bold arrow, and their bottom (non-coated) side is supported by three motorized rollers 51', 54, 53'. Subsequently, the panels 10 are supported by the upper outward section 31 of the belt conveyor again.

The three advancing motorized rollers 51', 54, 53' allow the advancing of the panels 10 analogously to the advancing motorized rollers 51, 52, 53 of the cleaning workstation 300. Nonetheless, they have a worked surface intended for diffusing the radiations emitted by an excimer emitter 56 for the treatment of the surfaces 1, 2, 3, 4, 5 of panels 10, as better explained in the following.

The rollers 51 and 53 are metal, mirror-polished rollers intended for diffusing the radiations emitted by the excimer emitter 56 for matting the head 2 and tail edges 5 of panels 10.

The roller 54, differently from roller 52, is provided with a reflecting, cone-shaped surface. The cone-shaped surface is intended for diffusing the radiations emitted by the excimer emitter 56 for the matting treatment, mainly for matting the longitudinal edges 3 and 4 of panels 10.

The excimer emitter 56 (visible in FIGS. 2 and 5) is a UV light source produced by the spontaneous emission of excimer molecules (excited dimers). In particular, in a preferred embodiment the wavelength used for this specific application is 172 nm, produced preferably by a xenon lamp. Nonetheless, excimer emitters emitting a slightly different wavelength can be used, inside a 165-185 nm range.

Figure 5:
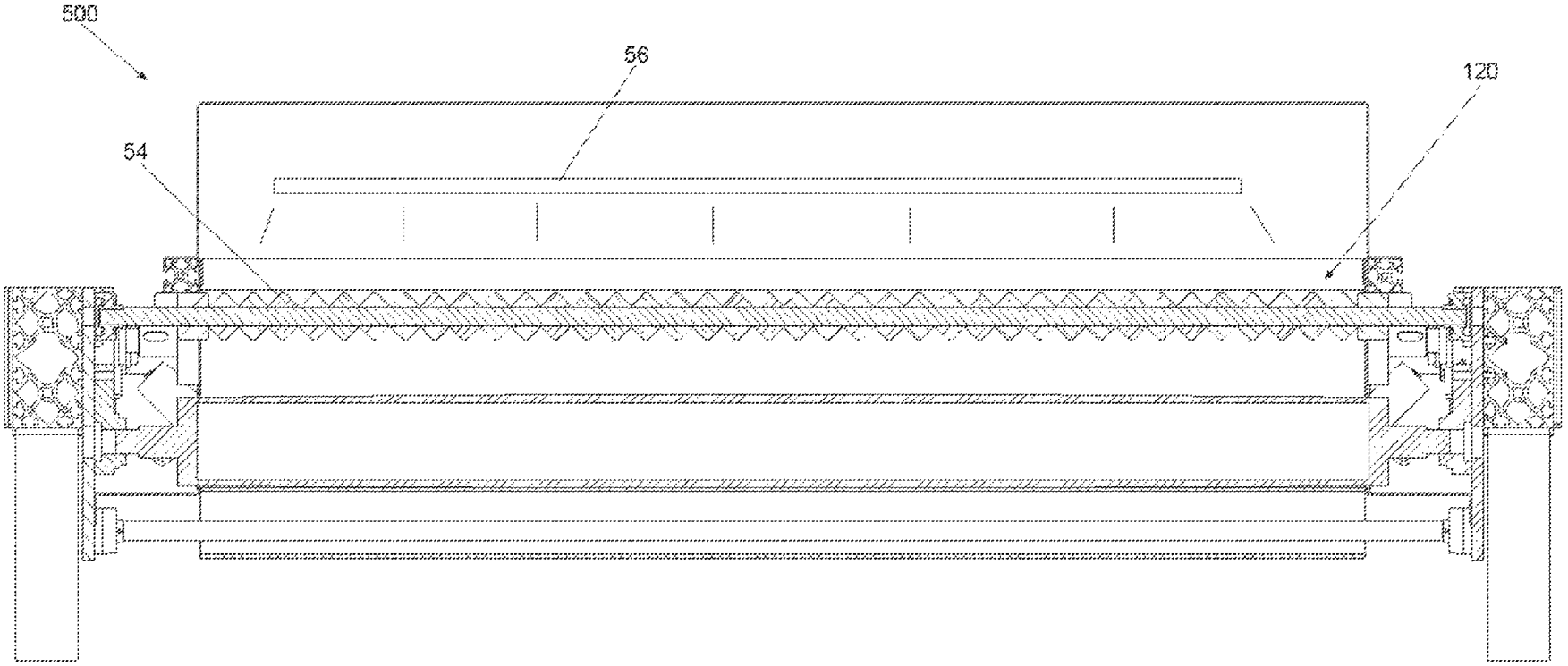
FIG. 5: Transversal section of the treatment workstation.

FIG. 5 shows a transversal section of the cleaning workstation 500 taken at the height of the advancing roller 54. Said Figure allows to better appreciate the geometry of the advancing roller 54, comprising a plurality of mirror cones, capable of reflecting the light emitted by the excimer emitter 56. FIG. 5 also allows appreciating the chamber 120 for panel conveying, closed and provided with inert atmosphere.

After a panel 10 has undergone the matting treatment through the excimer emitter 56, it continues on the final portion of the upper outward section 31 of the belt conveyor 30, and then leaves the apparatus 100 toward the subsequent workstation.

The matting method through excimer treatment comprises the following steps:

a) Coating a panel 10 preferably on five of its sides (main side 1 and lateral edges 2, 3, 4, 5), preferably spray-coating with a coating containing polymerizable monomers and a photoinitiator sensitive to UV radiation;

b) Optionally gelling the coating layer through UV radiations, preferably in a natural atmosphere;

c) Inserting the coated and gelled panel inside the treatment apparatus 100 in inert atmosphere, conveying it toward a cleaning workstation 300;

d) Cleaning the coated and gelled panel with gaseous nitrogen, intended for removing the oxygen molecules deriving from natural atmosphere;

e) Conveying said panel 10 in inert atmosphere toward the excimer treatment workstation 500;

f) Irradiating said panel 10 with excimer radiation in inert atmosphere;

g) Conveying the matted panel outside the treatment apparatus 100, in natural atmosphere again;

h) Optionally, definitively polymerizing the matted panel through an apparatus placed downstream the apparatus 100 according to the present invention.

The above-described method is the preferred embodiment for matting panels. Nonetheless, in an alternative embodiment, the gelling of the coating layer (step b) occurs in inert atmosphere inside the chamber 120 for conveying panels placed in the apparatus 100 according to the present invention. A further UV lamp is inserted for gelling downstream the initial workstation 200 for supplying nitrogen, but upstream the excimer treatment workstation 500, preferably between the cleaning workstation 300 and the treatment workstation 500.

1 main side
2 head edge
3 right longitudinal edge
4 left longitudinal edge
5 tail edge
10 panel
20 housing
21 motorized roller
22 idle roller
30 belt conveyor
31 upper outward section
32 lower return section
41 first roller
42 second roller
43 third roller
51 first advancing roller
52 second advancing roller
53 third advancing roller
54 worked second advancing roller
56 excimer emitter
57 pipes for oxygen suctioning
60 initial nitrogen supplying device
61 first nitrogen supplying device
62 second nitrogen supplying device
63 third nitrogen supplying device
64 fourth nitrogen supplying device
100 apparatus according to the present invention
120 conveying chamber
200 initial nitrogen supplying workstation
300 cleaning workstation
500 excimer treatment workstation

The invention claimed is:

1. An apparatus for matting a coating applied a panel, comprising:

a cleaning workstation; and an excimer treatment workstation, wherein said panel is conveyed by a belt conveyor provided with an upper outward section and a lower return section, wherein in said cleaning workstation and in said excimer treatment workstation the upper outward section of said belt conveyor has a V-shaped path defined by three rollers, of which a first roller and a third roller are in contact with a panel advancing plane, and a second roller is placed lower than the first and the third roller, and wherein, in correspondence of the V-shaped path, the panel moves on at least two advancing rollers, among which gaseous nitrogen is supplied, brushing all sides of the panel.

2. The apparatus according to claim 1, wherein, in said excimer treatment workstation, the upper outward section of the belt conveyor has a second V-shaped path formed by a group of three rollers, of which a first and a third roller are in contact with the panel advancing plane, and a second roller is placed lower than the first and the third roller, and wherein, in correspondence of the V-shaped path in said excimer treatment workstation, said panel moves on at least two advancing rollers, and said panel is irradiated by an excimer emitter.

3. The apparatus according to claim 1, wherein one of the advancing rollers the excimer treatment workstation is provided with a plurality of biconical sectors with reflecting surfaces.

4. The apparatus according to claim 2, wherein the first and the second advancing rollers in the excimer treatment workstation are motorized and made of mirror-polished metal.

5. The apparatus according to claim 1, wherein advancement of said panel occurs inside an inert chamber supplied with gaseous nitrogen, supplied by a plurality of laminar devices.

6. The apparatus according to claim 1, wherein said excimer treatment workstation is supplied by an excimer emitter placed inside the excimer treatment workstation.

7. The apparatus according to claim 1, wherein, at an entrance of said panel into the apparatus, there is provided an initial workstation supplying nitrogen.

* * * * *